United States Patent [19]

Van Hoose

[11] Patent Number: 4,770,642

[45] Date of Patent: Sep. 13, 1988

[54] IGNITION CABLE CONNECTOR

[76] Inventor: James S. Van Hoose, 2112 S. 164th Ave., Omaha, Nebr. 68130

[21] Appl. No.: 527,233

[22] Filed: Aug. 29, 1983

[51] Int. Cl.[4] ..... H01H 13/44; H01H 4/24

[52] U.S. Cl. ..... 439/127; 174/138 S; 439/427; 439/467; 439/596; 439/893

[58] Field of Search ..... 339/26, 95 R, 95 B, 339/100, 223 R, 223 S, 43, 44 R, 89 C, 97 S, 136 C, 140 S, 143 S, 149 S, 213 S, 217 SP, 220 A, 218 S, 255 B, 256 C, 256 RT, 258 C, 258 TC, 263 S, 96 97 R; 174/138 S

[56] References Cited

U.S. PATENT DOCUMENTS

| | | | |
|---|---|---|---|
| 1,077,002 | 10/1913 | Schmidt | 339/213 S |
| 1,175,343 | 3/1916 | Conrad | 339/100 |
| 1,806,548 | 5/1931 | Rabezzana | 339/26 X |
| 2,149,027 | 2/1939 | Meredith | 339/143 S X |
| 2,228,138 | 1/1941 | Larkin, Jr. | 339/258 TC X |
| 2,453,615 | 11/1948 | Bergan | 339/100 |
| 2,476,429 | 7/1949 | Paules | 39/100 |
| 2,724,092 | 11/1955 | Simpkins et al. | 339/256 C X |
| 3,064,228 | 11/1962 | Knowlton | 339/100 |
| 3,423,718 | 1/1969 | Cea | 339/100 |
| 3,427,553 | 2/1969 | Smulowitz et al. | 339/97 R |
| 3,745,228 | 7/1973 | Vogt | 174/88 |
| 3,793,616 | 2/1974 | Moehrke | 339/223 S |
| 3,820,059 | 6/1974 | Gibbons | 339/100 |
| 3,920,305 | 11/1975 | Scott | 339/98 |
| 3,997,233 | 12/1976 | Evans | 339/97 |
| 4,037,905 | 7/1977 | Lucas | 339/98 |
| 4,274,695 | 6/1981 | Fukumori et al. | 339/256 C X |
| 4,413,872 | 11/1983 | Rudy, Jr. et al. | 339/95 R X |
| 4,443,047 | 4/1984 | Hofmann | 339/26 |

FOREIGN PATENT DOCUMENTS

| | | | |
|---|---|---|---|
| 1007431 | 2/1952 | France | 339/26 |
| 308325 | 6/1933 | Italy | 339/26 |

*Primary Examiner*—Gil Weidenfeld
*Assistant Examiner*—Steven C. Bishop
*Attorney, Agent, or Firm*—Zarley, McKee, Thomte, Voorhees & Sease

[57] ABSTRACT

A connector for terminating the distributor end of ignition cables includes a conductive insert fitted within an outer boot. A spring-lock barrel of the conductive insert is arranged within a generally cylindrical head portion of the boot and a wire-piercing prong which extends radially outwardly from the barrel extends generally centrally into a cylindrical neck portion of the boot. The neck portion has a hinged cover with insulation piercing prongs to prevent axial withdrawal of a cable from the connector.

16 Claims, 3 Drawing Sheets

IGNITION CABLE CONNECTOR

BACKGROUND OF THE INVENTION

The present invention is directed generally to a prefabricated distributor boot assembly for an automotive ignition cable and more particularly to a distributor boot assembly which can be quickly and easily installed onto the end of an ignition cable in a manner to provide a reliable mechanical and electrical connection thereto.

The need for the present invention is apparent upon reviewing the history of automotive ignition wires. Between 1920 and 1957, mechanics generally fabricated their own ignition wires by cutting a lead from a roll of wire and fastening terminals on the opposite ends and placing boots over the terminals. A five-step process was involved: cutting the wire, stripping th wire, folding the conductor back, attaching the terminal, and pulling the boot over the terminal.

Between 1957 and 1975, federal regulations began to require radio static suppression. The inner conductor of ignition wires were changed to graphite impregnated string, thereby making field stripping hazardous because of possible damage to the fragile inner conductor.

During this time between 1957 and 1975, the custom spark plug wire set became the mode of the replacement parts business. The custom set is a set of spark plug wires which are precut and terminated in the factory of its origin and ultimately installed by the mechanic or retail purchaser. The custom set requires no tool or labor on the part of the installer to fit to the proper engine size.

In the early 1970's, under hood temperatures were increasing dramatically because of the introduction of pollution control devices. As temperatures increased, former jacketing on spark plug wires became less effective. Silicone was substituted for hypalon because of its higher temperature ranges. Electronics were becoming more important for the same reasons. In 1975, electronic high energy ignition systems became the industry standard. The evolution of electronics increased voltage in the ignition system to 35,000 volts. Formerly, 7 mm jacketing on ignition wires was satisfactory in containing the voltage surging through the spark plug wires but another millimeter of insulation was added to contain the high voltage of the new system.

This added millimeter of insulation and changes in the termination of spark plug wires nearly demanded a factory terminated distributor terminal and boot. Since the termination of the distributor end became even more complex, the practice of many mechanics and do-it-yourselfers of using universal spark plug wire sets was practically eliminated. A universal spark plug wire set is a set of spark plug wires which has a factory terminated spark plug end and requires that the purchaser cut, strip, fold and terminate the distributor end. This procedure requires knowledge and special tools.

Currently, there are more than 1600 years, makes and models of automobiles and trucks on our roads. This requires production and inventory of more than 150 custom spark plug wire sets to meet 90% coverage of automobiles and trucks in service today. Hence there is a parts proliferation. With constantly changing design and performance characteristics of engines, a virtual parts explosion is being experienced. By 1985, the cost of inventory and the number of spark plug wire sets required to meet supply and demand will have nearly doubled.

Accordingly, a principal object of the invention is to provide an improved ignition cable connector.

Another object is to provide an ignition cable connector which may be readily installed by even an inexperienced operator to achieve a reliable mechanical and electrical connection between the connector and cable.

Another object is to provide an improved ignition cable connector which may be installed without special tools.

Another object is to provide an ignition cable connector which will enable the use of universal spark plug wire sets for modern high energy systems.

Finally, a further object is to provide an ignition cable connector which is simple and rugged in construction, inexpensive to manufacture and efficient in operation.

SUMMARY OF THE INVENTION

The ignition cable connector of the present invention includes an electrically conductive insert mounted within an electrically insulating boot. The conductive insert has a spring-lock barrel with an integral wire piercing prong extended radially from it. The spring-lock barrel is positioned within an upright generally cylindrical head portion of the boot and the wire-piercing prong extends outwardly through a side wall opening of the head portion into a generally cylindrical neck portion. The neck portion has a hinged cover so that an ignition cable may be easily inserted therein with its center conductor being pierced by the wire-piercing prong of the conductive insert. A hinged cover on the neck portion has an insulation piercing means on its interior surface for preventing axial withdrawal of the ignition cable upon closing of the hinged cover. A locking mechanism maintains the hinged cover in its closed position.

The hinged cover may simply be a top wall of the neck portion or the boot may be split through both the neck portion and head portion so that the hinged cover is connected to the remainder of the neck portion by the split head portion sections.

The ignition cable connector of the invention thus enables the distributor end of an ignition cable to be quickly and easily terminated in a manner to provide a reliable mechanical and electrical connection and without special tools. The invention thus eliminates the need to field strip wires and reduces the process for terminating the wire by three steps. The present invention furthermore eliminates the need for special skill or training to terminate ignition cables. Finally, the ignition cable connector of the present invention will operate to substantially reduce parts proliferation in the automotive parts industry and will make the replacement of ignition cables more affordable for all.

DESCRIPTION OF THE PREFERRED EMBODIMENTS

Figure 1:
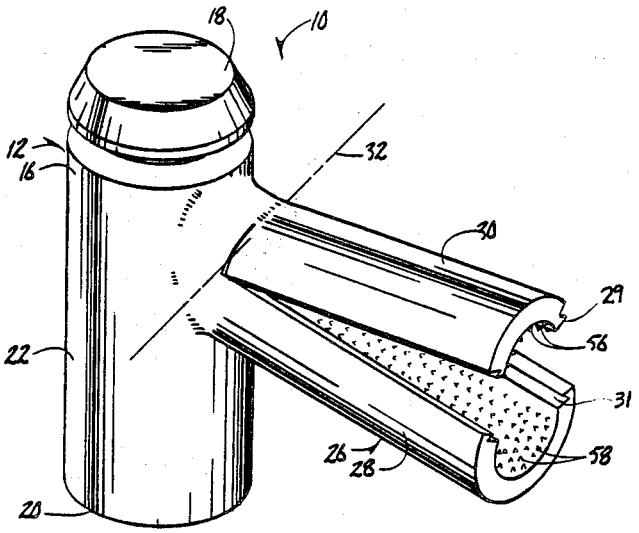
FIG. 1 is a perspective view of an 8 mm model of the invention.

The ignition cable connector 10 shown in FIGS. 1–4 includes an outer boot 12 which covers and insulates a conductive insert 14. The boot 12 is a somewhat L-shaped flexible member having an upright generally cylindrical head portion 16 which includes a top wall 18, an open bottom end 20 and a side wall 22 having an opening 24. Opening 24 provides access to the generally cylindrical neck portion 26 which extends generally radially from the head portion 16 in registration with the side wall opening 24.

Figure 3:
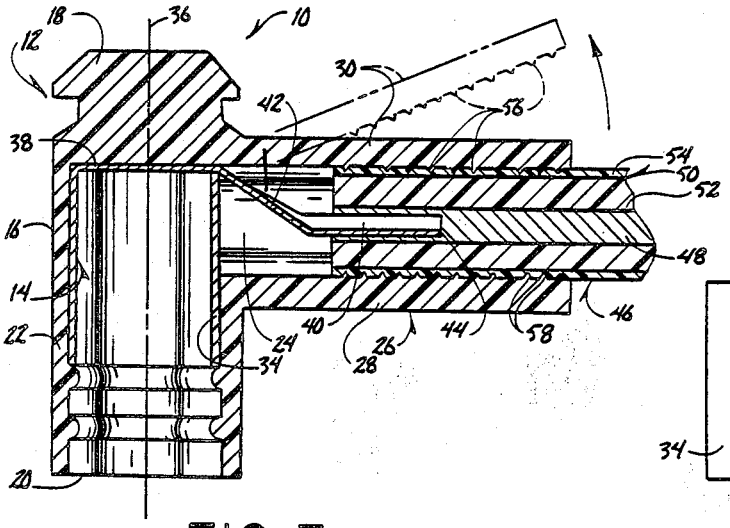
FIG. 3 is a side sectional view of the assembled connector of FIG. 1.

Neck portion 26 has an elongated channel-shaped base portion 28 and a hinged cover 30 pivotally movable between the dotted line open position and solid line closed position of FIG. 3. The hinged cover 30 is preferably pivotally movable about a pivot axis extended transversely of the neck portion, as indicated generally at 32. A lock means such as the interlocking press-fit Z section edges 29 and 31 on cover 30 and base portion 28 serve to retain the hinged cover in its closed position.

Figure 2:
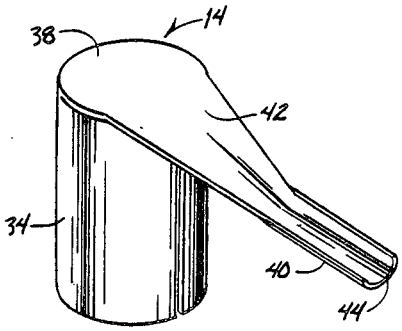
FIG. 2 is a perspective view of the conductive insert for the connector of FIG. 1.
Figure 4:
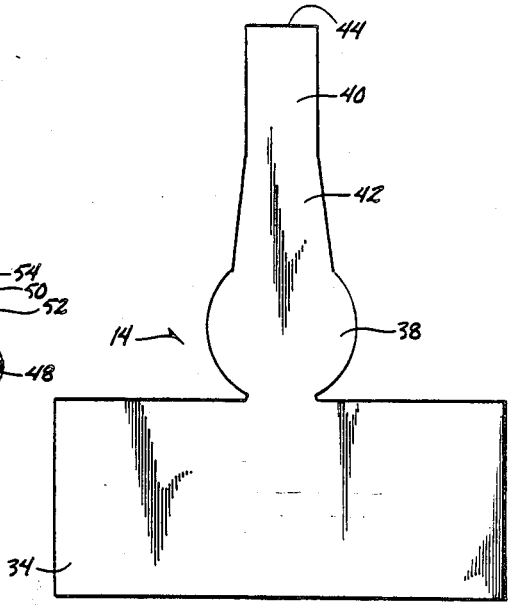
FIG. 4 is a plan view of the blank for the conductive insert of FIG. 2.

The conductive insert 14 may be formed from an integral blank 32 of metal material as indicated in FIG. 4 to provide the part shown in FIG. 2. Insert 14 includes an elongated spring-lock barrel 34 having an upright center axis 36 (FIG. 3), a top wall 38 and an integral wire-piercing prong 40 extended generally radially from the barrel 34. Barrel 34 is an 8 mm female barrel adapted to be snapped onto a high energy distributor cap.

The wire-piercing prong 40 is preferably arcuate in cross section for added strength. It is preferably disposed perpendicular to the barrel 34 and axially displaced from the top wall 38 of the barrel by an inclined connector link 42. It is preferred that the pivot axis 32 for the hinged cover 30 be situated closer to the head portion 16 and the free end 44 of the wire-pierciing prong 40 so that the prong is both visible and easily accessible when assembling the connector.

As shown in FIG. 3, the conductive insert 14 is arranged in the boot 12 with the spring-lock barrel 34 in the head portion 16 and the wire-piercing prong 40 extending generally centrally into the neck portion 26. The boot is sufficiently flexible to enable the conductive insert to be press-fit therein during assembly. The boot material should be more rigid than rubber, however, and thus may be provided as a plastic such as polyvinyl chloride or a thermal plastic compound for accommodating the high and low heat ranges associate with an automotive engine.

The conductive insert 14 is preferably formed from tin plated steel, stainless steel or brass.

In FIG. 3, connector 10 is shown as installed on the end of an ignition cable 46 which has a center conductor 48 and an annular insulation cover 50. Cover 50 may include both a fiberglass insulation layer 52 and an outer silicon cover 54.

In operation, hinged cover 30 is pivoted upwardly to the dotted line open position of FIG. 3 whereupon the ignition cable 46 is axially pressed into channel portion 28 so that the wire-piercing prong 40 enters the center conductor 48 to establish an electrical connection between them. The hinged cover 30 is then lowered to its closed solid lin position of FIG. 3 and snap-locked in that position by the interlocking edges 29 and 31.

To prevent axial withdrawal of the cable 46, the underside of hinged cover 30 is provided with an insulation piercing means such as the plurality of integral interiorly protruding prongs 56 shown in FIGS. 1 and 3. Similar prongs 58 are preferably provided in the interior surface of the channel-shaped base portion 28 as well.

Figure 5:
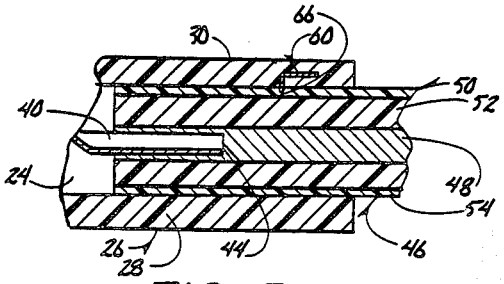
FIG. 5 is a partial sectional view of an alternate embodiment for the insulation piercing means of the boot neck portion.
Figure 6:
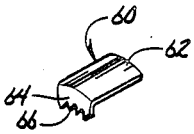
FIG. 6 is a perspective view of the tab of FIG. 5.

An alternate insulation piercing means is shown in FIGS. 5 and 6. Instead of the integral prongs 56 and 58, a generally L-shaped tab 60 has an elongated leg portion 62 embedded within the hinged cover 30 as shown in FIG. 5 with a foot portion 64 extending interiorly from the cover for piercing the insulation of a cable inserted into the connector. As shown in FIG. 6, the tab 60 is of somewhat arcuate shape and the interior edge of foot portion 64 may be serrated as at 66 for an improved bite into the cable insulation 50.

Figure 7:
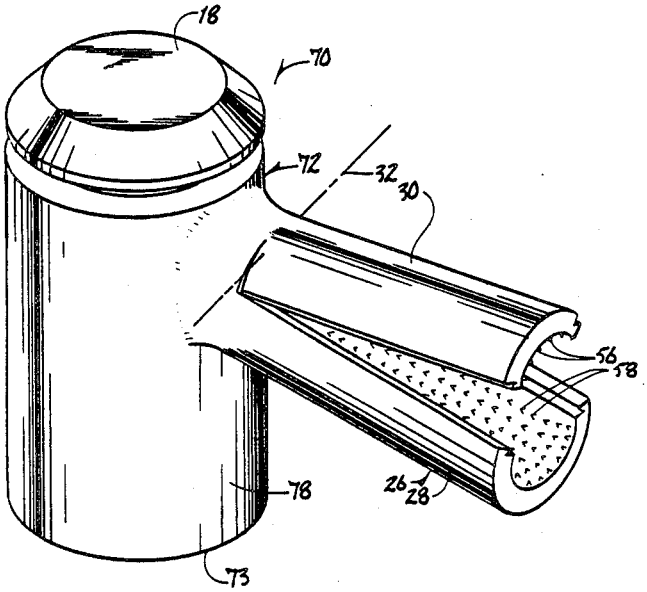
FIG. 7 is a perspective view of a 7 mm model of the invention.
Figure 8:
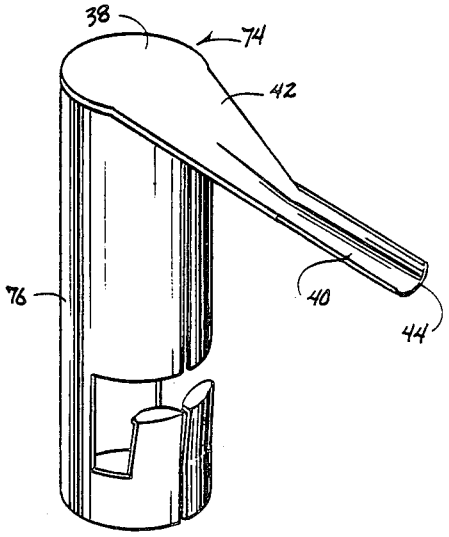
FIG. 8 is a perspective view of the conductive insert for the connector of FIG. 7.
Figure 9:
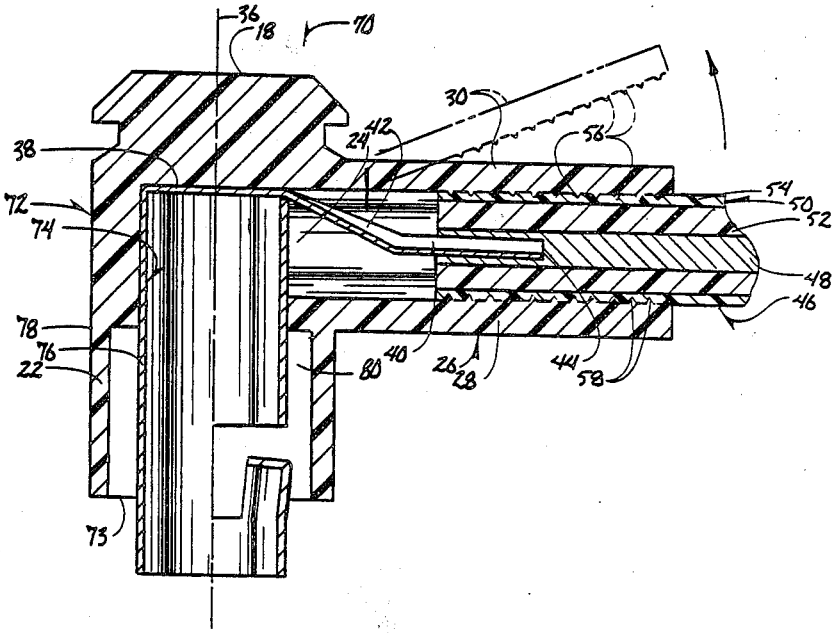
FIG. 9 is a side sectional view of the connector of FIG. 7.

Another embodiment of the invention is shown in FIGS. 7–9. The connector 70 is similar to connector 10, with the primary difference being that the conductive insert 74 has a spring-lock barrel 76 of the 7 mm male type. The open bottom end 73 of the boot head portion 78 is formed sufficiently wide to provide a recess 80 to accommodate a snap-fit of the spring-lock barrel 76 onto a distributor. The 7 mm male type connector 70 is otherwise similar to the 8 mm female model connector 10 as evident by a comparison of FIGS. 9 and 3.

Figure 10:
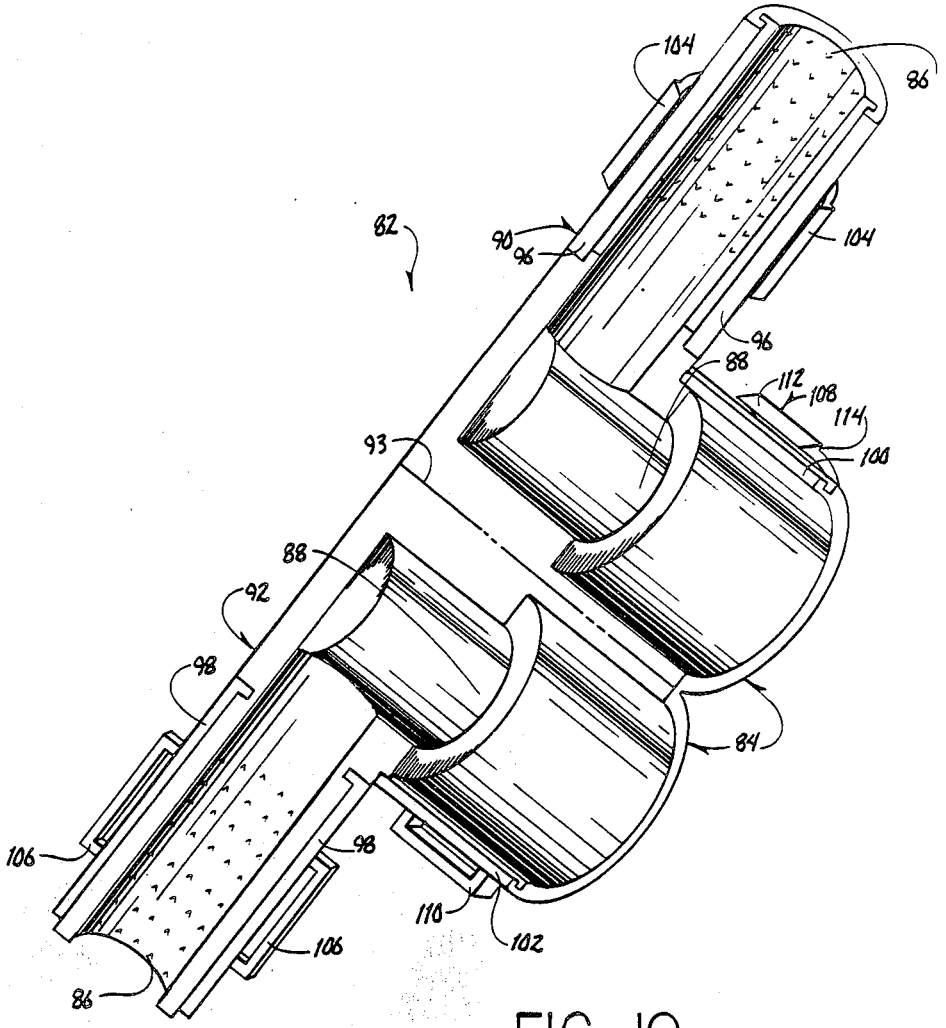
FIG. 10 is a top plan view of an alternate split boot for the connector.

FIG. 10 illustrates an alternate embodiment for a boot 82. In this embodiment, the head portion 84 and neck portion 86 are split along a plane intersecting the side wall opening 88 and disposed generally parallel to the central axis of the head portion to define a pair of split connector portions 90 and 92 which are hingedly connected together along one side wall as indicated at 92.

Figure 11:
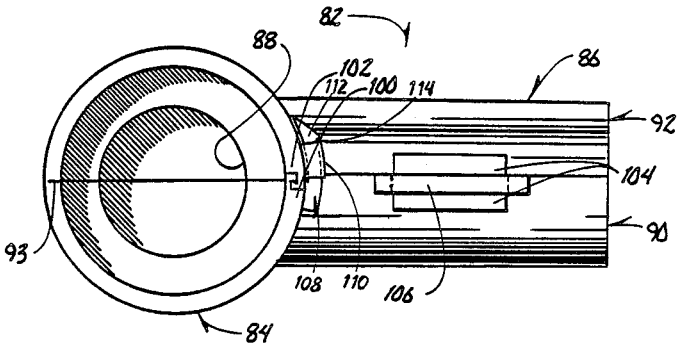
FIG. 11 is a bottom view of the split boot in its closed position.

Boot 82 is of a type adapted to receive the 7 mm male type conductive insert 74 of FIG. 8. When the split connector portions 90 are pivoted to their closed positions of FIG. 11, the boot 82 quite closely resembles the boot 72 of connector 70 in FIG. 9. In the embodiment of FIG. 10, however, the neck portion 86 of split connector portion 90 may be regarded as the hinged cover and the neck portion 86 of split connector portion 92 may be regarded as the channel-shaped base portion.

The means for locking the split connector portions 90 and 92 together in their closed position includes interlocking edges 96 and 98 on the neck portions of split connector portions 90 and 92 and similar interlocking edges 100 and 102 on the head portion of split connector portions 90 and 92.

Whereas the interlocking edges 96, 98 and 100, 102 provide an effective voltage barrier, additional mechanical locking may be afforded by tabs 104 having hooked end portions adapted to be inserted through coacting latches 106 on connector portion 92. A similar tab 108 and latch 110 arrangement is provided on the head portion. The hooked end 112 of tab 108 presents a rearward shoulder 114 which engages the edge of latch 110 to secure the connector portions in their closed and latched positions.

Thus there has been shown and described a prefabricated distributor boot assembly which provides a reliable mechanical and electrical connection and which can be assembled with any conventional pliers. Several connectors according to the invention can be quickly and easily installed to provide a high quality tailored set of ignition cables.

I claim:

1. A connector for the distributor end of an automotive ignition cable having a center connector enclosed within an annular insulation cover, comprising a conductive insert including an elongated generally cylindrical spring-lock barrel having an upright center axis and an integral wire-piercing prong extended generally radially therefrom, a boot formed of an electrically insulating material and comprising an upright generally cylindrical head portion having a closed top wall, and open bottom end and a side wall having an opening therein, and a generally cylindrical neck portion extended generally radially from said head portion in registration with said side wall opening, said conductive insert being arranged in said boot with said spring-lock barrel generally concentrically positioned in said head portion and said wire-piercing prong extending generally centrally into said neck portion whereby, upon insertion of an ignition cable into said neck portion, the central conductor thereof is pierced by said wire-piercing prong.

said neck portion including an elongated channel-shaped base portion and a hinged cover pivotally movable between open and closed positions, one of said base portion and hinged cover having interior and exterior surfaces and insulation piercing means on said interior surface whereby the insulation cover of an ignition wire located into said neck portion is engaged by said insulation piercing means upon closing of said hinged cover, thereby preventing the axial withdrawal of the ignition cable from said neck portion, and lock means for retaining said hinged cover in the closed position thereof.

2. The connector of claim 1 wherein said hinged cover is pivotally movable about a pivot axis extended transversely of said neck portion.

3. The connector of claim 2 wherein said wire-piercing prong has one end connected to said spring-lock barrel and an opposite free end, said pivot axis being arranged closer to said head portion than said free end of the wire-piercing prong.

4. The connector of claim 1 wherein said spring-lock barrel has a top wall, said wire-piercing prong comprising an integral extension of said top wall.

5. The connector of claim 4 wherein said wire-piercing prong has an arcuate shape in transverse cross section.

6. The connector of claim 1 wherein said lock means comprises coacting fastener means on said hinged cover and channel portion, which fastener means are operative to be engaged upon closing of said hinged cover.

7. The connector of claim 6 wherein said lock means comprises mating generally V-shaped edges on said hinged cover and channel portion.

8. The connector of claim 1 wherein said insulation piercing means comprises a plurality of integral interiorly protruding prongs on said interior surface.

9. The connector of claim 1 wherein said insulation piercing means comprises a generally L-shaped tab having a base leg embedded within said hinged cover and a foot portion protruding interiorly from the interior surface of said hinged cover.

10. The connector of claim 1 wherein said conductive insert comprises an integral formed piece of metal material.

11. The connector of claim 1 wherein said spring-lock barrel comprises a 7 mm male barrel portion.

12. The connector of claim 1 wherein said spring-lock barrel comprises an 8 mm female barrel portion.

13. The connector of claim 1 wherein said head portion and neck portion are split along a plane intersecting said side wall opening and disposed generally parallel to the central axis of said head portion, to define a pair of split connector portions and means for hingedly connecting said split connector portions together.

14. The connector of claim 13 wherein said lock means comprises interlocking edges on said split connector portions, said interlocking edges being releasably locked together upon closing of said hinged cover.

15. The connector of claim 14 wherein said split connector portions are pivotally movable between open and closed positions and further comprising second lock means for retaining said split connector portions in the closed positions thereof.

16. The connector of claim 15 wherein said second lock means comprises a pair of hooks extended from one split connector portion and a pair of latches on the other split connector portion for receiving said hooks upon pivotal movement of said split connector portions to the closed positions thereof.

* * * * *